US011554598B2

(12) United States Patent
Koshiba

(10) Patent No.: US 11,554,598 B2
(45) Date of Patent: Jan. 17, 2023

(54) INKJET PRINTER

(71) Applicant: MIMAKI ENGINEERING CO., LTD., Nagano (JP)

(72) Inventor: Sho Koshiba, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 17/022,130

(22) Filed: Sep. 16, 2020

(65) Prior Publication Data

US 2021/0078344 A1 Mar. 18, 2021

(30) Foreign Application Priority Data

Sep. 18, 2019 (JP) ..... JP2019-169085

(51) Int. Cl.
*B41J 25/308* (2006.01)
*B41J 25/316* (2006.01)
*B41J 19/20* (2006.01)

(52) U.S. Cl.
CPC ..... *B41J 25/316* (2013.01); *B41J 19/205* (2013.01); *B41J 25/308* (2013.01)

(58) Field of Classification Search
CPC ..... B41J 25/308; B41J 25/316; B41J 3/4073; B41J 3/40733
See application file for complete search history.

(56) References Cited

U.S. PATENT DOCUMENTS 6,360,656 B2 * 3/2002 Kubo ..... B41J 2/01 101/35
2003/0043246 A1 * 3/2003 Codos ..... B41J 2/01 347/102
2020/0316962 A1 * 10/2020 Bullington ..... B41J 2/17566

FOREIGN PATENT DOCUMENTS

| | | |
|---|---|---|
| CN | 110014736 | 7/2019 |
| JP | 2009248559 | 10/2009 |
| JP | 2011042088 | 3/2011 |

OTHER PUBLICATIONS

"Office Action of China Counterpart Application", dated Nov. 15, 2021, with English translation thereof, p. 1-p. 11.

* cited by examiner

*Primary Examiner* — Scott A Richmond
(74) *Attorney, Agent, or Firm* — JCIPRNET

(57) ABSTRACT

An inkjet printer capable of improving uniformity of the quality of an image printed on a recording medium is provided and includes: a table formed with a support surface that supports a recording medium; an inkjet head formed with a nozzle that ejects ink; a Y-bar that supports the inkjet head to be movable in a main scanning direction; two lifting mechanisms capable of changing a Y-bar tilt serving as a tilt of the Y-bar with respect to the support surface; a head gap sensor that detects a head gap, which is a distance from the recording medium to the nozzle of the inkjet head; and a tilt adjustment portion that adjusts the Y-bar tilt by the two lifting mechanisms to a tilt that reduces variations of the head gaps detected by the head gap sensor at each of multiple positions in the main scanning direction.

1 Claim, 11 Drawing Sheets

INKJET PRINTER

CROSS REFERENCE TO RELATED APPLICATIONS

This application claims the priority benefit of Japanese Patent Application No. 2019-169085, filed on Sep. 18, 2019. The entirety of the above-mentioned patent application is hereby incorporated by reference herein and made a part of this specification.

TECHNICAL FIELD

The present disclosure relates to an inkjet printer that ejects ink.

DESCRIPTION OF THE BACKGROUND ART

As a conventional inkjet printer, a so-called flat-bed type inkjet printer including a table on which a support surface that supports a recording medium is formed; an inkjet head that ejects ink toward the surface of the recording medium supported on the support surface; a Y-bar that extend in a main scanning direction of an extending direction of the support surface and that supports the inkjet head to be movable in the main scanning direction; two slide mechanisms that move the Y-bar in a sub scanning direction orthogonal to the main scanning direction of the extending direction of the support surface with respect to the recording medium; and a suction device that adsorbs the recording medium on the support surface by suctioning gas through a plurality of suction holes formed on the support surface of the table is known (see Japanese Unexamined Patent Publication No. 2011-042088, Patent Literature 1).

Furthermore, as a conventional inkjet printer, an inkjet printer including an inkjet head formed with an ink ejection surface where nozzles that eject ink toward the surface of a recording medium are formed; and a mechanism that adjusts a head gap which is a distance from the surface of the recording medium to the ink ejection surface of the inkjet head is also known (see Japanese Unexamined Patent Publication No. 2009-248559, Patent Literature 2).

Patent Literature 1: Japanese Unexamined Patent Publication No. 2011-042088

Patent Literature 2: Japanese Unexamined Patent Publication No. 2009-248559

The flat-bed type inkjet printer described in Japanese Unexamined Patent Publication No. 2011-042088 can suppress lifting of the recording medium from the support surface of the table by adsorbing the recording medium to the support surface of the table with the suction device.

However, if the recording medium is relatively thick, such as a relatively thick acrylic plate, for example, even if the recording medium is maximally adsorbed to the support surface of the table by the suction device, the end of the recording medium may lift up from the support surface of the table. If the end of the recording medium lift up from the support surface of the table, the head gap at each of a plurality of positions in the main scanning direction tend to vary.

Here, as a method of adjusting the head gap, a method of moving the inkjet head up and down in a vertical direction is known, as described in Japanese Unexamined Patent Publication No. 2009-248559.

However, in the flat-bed type inkjet printer described in Japanese Unexamined Patent Publication No. 2011-042088, when the end of the recording medium are lifted from the support surface of the table, the variation in the head gap at each of a plurality of positions in the main scanning direction is not reduced even if the head gap is adjusted by moving the inkjet head up and down in the vertical direction. Therefore, if the head gap is adjusted with reference to the portion of the recording medium that is lifted from the support surface of the table, the head gap becomes large for the portion of the recording medium that is not lifted from the support surface of the table, and as a result, the accuracy of the landing position of the ink on the recording medium may become poor and the quality of the image printed on the recording medium may lower due to the flight deflection of the ink ejected toward the recording medium by the inkjet head, and the like.

Furthermore, in the flat-bed type inkjet printer described in Japanese Unexamined Patent Publication No. 2011-042088, if the thickness of the recording medium supported on the table is not uniform even if the end of the recording medium is not lifted from the support surface of the table, the head gap is adjusted by moving the inkjet head up and down in the vertical direction with reference to the portion having a thick thickness of the recording medium supported by the table, so that the head gap becomes large for the portion having a thin thickness in the vertical direction of the recording medium supported by the table, and as a result, the accuracy of the landing position of the ink on the recording medium may become poor and the quality of the image printed on the recording medium may lower due to the flight deflection of the ink ejected toward the recording medium by the inkjet head, and the like.

For various reasons such as those described above, the conventional inkjet printer has a problem that the quality of the image printed on the recording medium is not uniform depending on the printing location.

Therefore, the present disclosure provides an inkjet printer that can improve the uniformity of quality in an image printed on a recording medium.

SUMMARY

A first aspect of the present disclosure is an inkjet printer that includes: a table provided with a support surface for supporting a recording medium, and the support surface being a plane extending in an X direction and a Y direction orthogonal to each other; an inkjet head provided with an ink ejection surface that ejects ink toward a surface of the recording medium supported by the support surface; a position changing mechanism, configured to change a position of the ink ejection surface with respect to the surface in at least one of the X direction and the Y direction by relatively moving one of the table and the inkjet head with respect to the other one of the table and the inkjet head in at least one of the X direction and the Y direction; a position sensor, configured to detect a position of the ink ejection surface with respect to the surface in a Z direction orthogonal to both the X direction and the Y direction; and an adjustment mechanism, configured to: change the position of the ink ejection surface with respect to the surface by the position changing mechanism, detect the position in the Z direction at a plurality of points in a direction orthogonal to the Z direction by the position sensor, and adjust the position of the ink ejection surface with respect to the surface in the Z direction to reduce variation in a head gap, which is a distance in the Z direction from the surface to the ink ejection surface at the plurality of points.

With this configuration, the inkjet printer of the present disclosure adjusts the position of the ink ejection surface of the inkjet head with respect to the surface of the recording medium in the Z direction to reduce the variation in the head gap at a plurality of points in the direction orthogonal to the Z direction, and thus can improve the uniformity in the direction orthogonal to the Z direction of the accuracy of the landing position of the ink ejected toward the surface of the recording medium by the inkjet head to the surface of the recording medium, and consequently, can improve the uniformity in the direction orthogonal to the Z direction of the quality of the image printed on the surface of the recording medium.

In the inkjet printer according to a second aspect of the present disclosure, the position changing mechanism may include a main scan mechanism that extends in a main scanning direction serving as the Y direction and supports the inkjet head so as to be movable in the main scanning direction; and the adjustment mechanism may include: a tilt changing mechanism, configured to be capable of changing a main scan mechanism tilt serving as a tilt of the main scan mechanism with respect to the support surface in an orthogonal surface orthogonal to the support surface, and a tilt adjustment portion, configured to adjust the main scan mechanism tilt by the tilt changing mechanism to a tilt that reduces variations in the head gap detected by the position sensor at each of a plurality of positions in the main scanning direction.

With this configuration, the inkjet printer of the present disclosure adjusts the main scan mechanism tilt by the tilt changing mechanism to a tilt that reduces the variation of the head gap detected by the position sensor at each of a plurality of positions in the main scanning direction to reduce the variation in the head gap at each of the plurality of positions in the main scanning direction, and thus can improve the uniformity in the main scanning direction of the accuracy of the landing position of the ink ejected toward the surface of the recording medium by the inkjet head to the surface of the recording medium, and consequently, can improve the uniformity in the main scanning direction of the quality of the image printed on the surface of the recording medium.

In the inkjet printer according to a third aspect of the present disclosure, the position changing mechanism may include a sub scan mechanism configured to allow one of the recording medium and the main scan mechanism to move in the sub scanning direction as the X direction with respect to the other one of the recording medium and the main scan mechanism; and the tilt adjustment portion may be configured to adjust the main scan mechanism tilt by the tilt changing mechanism to a tilt that reduces variation in the head gaps detected by the position sensor at each of the plurality of positions in the main scanning direction at each of the plurality of positions in the sub scanning direction.

With this configuration, the inkjet printer of the present disclosure reduces the variation in the head gap detected by the position sensor at each of a plurality of positions in the main scanning direction at each of a plurality of positions in the sub scanning direction, and thus can improve the uniformity in both the main scanning direction and the sub scanning direction of the accuracy of the landing position of the ink ejected toward the surface of the recording medium by the inkjet head to the surface of the recording medium, and consequently, can improve the uniformity in both the main scanning direction and the sub scanning direction of the quality of the image printed on the surface of the recording medium.

In the inkjet printer according to a fourth aspect of the present disclosure, the tilt changing mechanism is configured to be capable of changing the main scan mechanism tilt by changing the position in the Z direction of each end of the main scan mechanism in the main scanning direction; and when the main scan mechanism tilt is adjusted by the tilt changing mechanism, the tilt adjustment portion may be configured to adjust the position in the Z direction of each end of the main scan mechanism in the main scanning direction by the tilt changing mechanism to a position where an average of the head gaps detected by the position sensor becomes a specific value at each of a plurality of positions in the main scanning direction.

With this configuration, the inkjet printer of the present disclosure realizes both the change of the main scan mechanism tilt and the change of the average of the head gaps detected by the position sensor at each of the plurality of positions in the main scanning direction by the tilt changing mechanism, and thus the size can be reduced as compared with a configuration in which a mechanism for changing the average of the head gaps at each of a plurality of positions in the main scanning direction is provided other than the tilt changing mechanism.

The inkjet printer of the present disclosure can improve the uniformity of quality in an image printed on a recording medium.

DESCRIPTION OF EMBODIMENTS

Hereinafter, an embodiment of the present disclosure will be described with reference to the drawings.

First, the configuration of an inkjet printer according to the present embodiment will be described.

Figure 1:
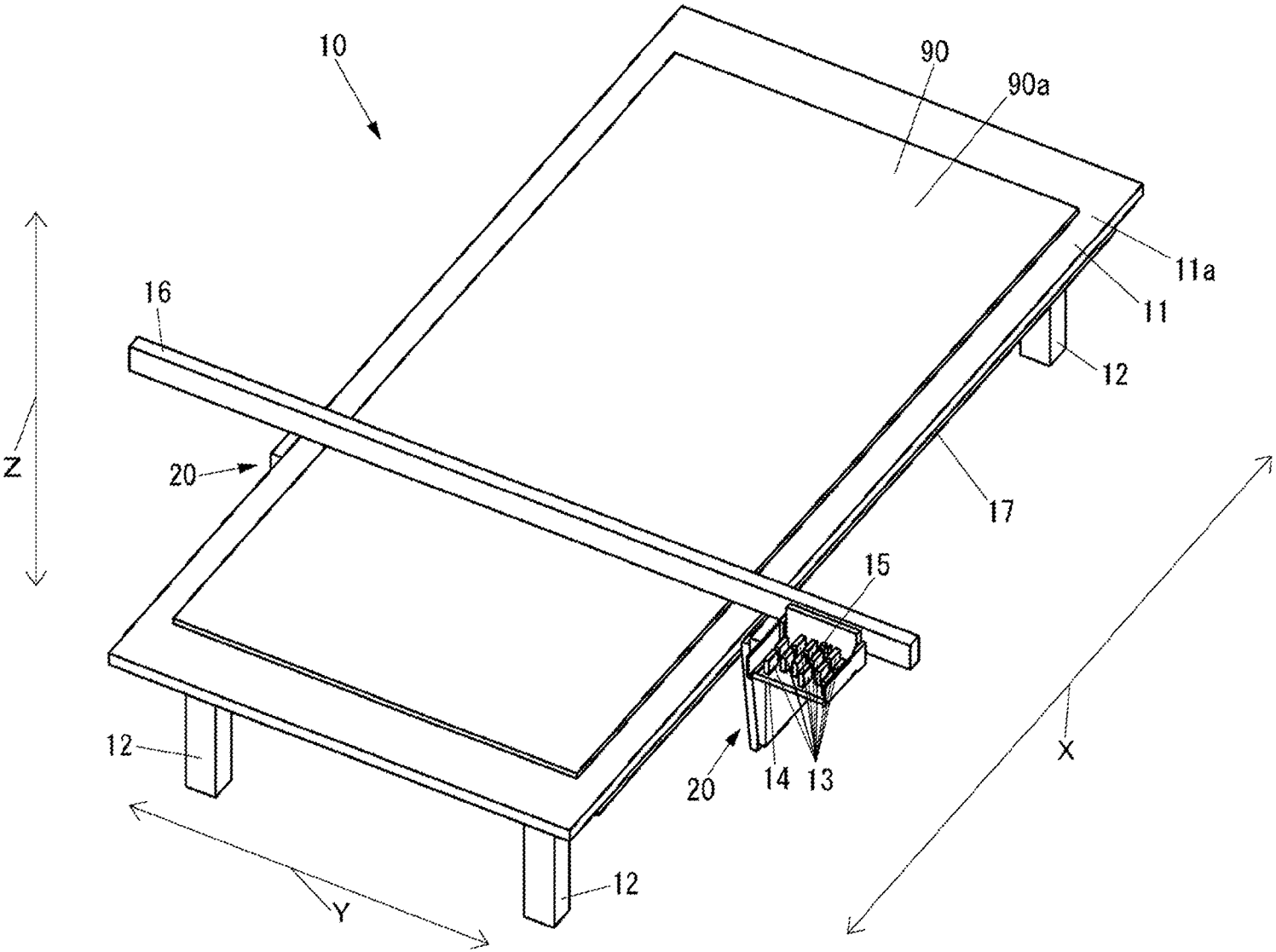
FIG. 1 is a schematic perspective view of an inkjet printer according to an embodiment of the present disclosure.
Figure 2:
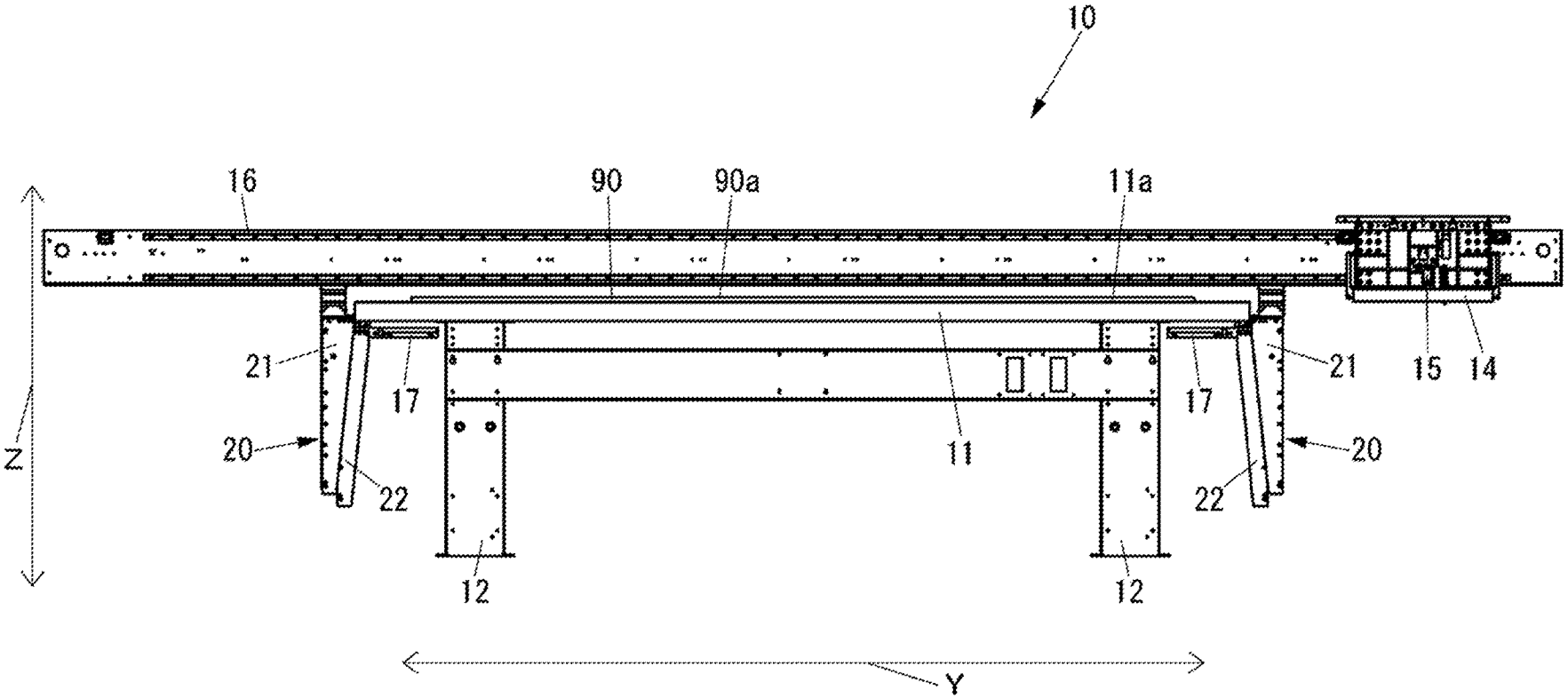
FIG. 2 is a front view of the inkjet printer shown in FIG. 1.
Figure 3:
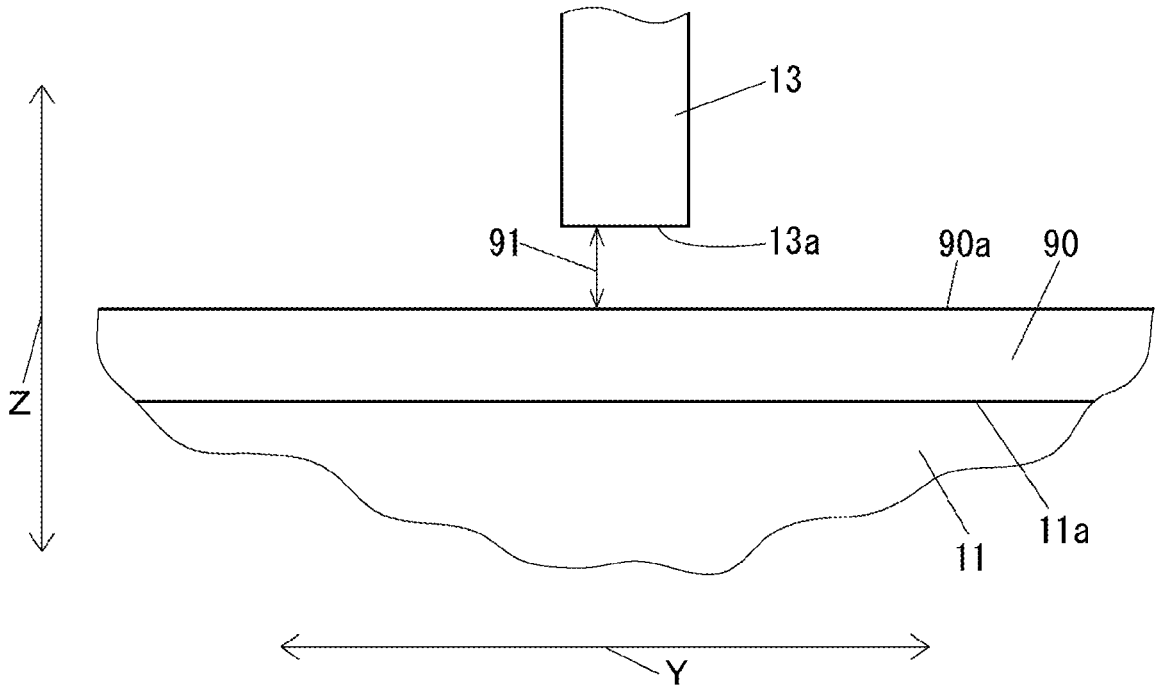
FIG. 3 is a front view of the vicinity of an ink ejection surface of the inkjet head when the inkjet head shown in FIG. 1 is arranged in a vertical direction with respect to a recording medium.

FIG. 1 is a schematic perspective view of an inkjet printer 10 according to the present embodiment in a state where a recording medium 90 is supported on a table 11. FIG. 2 is a front view of the inkjet printer 10. FIG. 3 is a front view of the vicinity of an ink ejection surface 13*a* of an inkjet head 13 when the inkjet head 13 is arranged in the vertical direction with respect to the recording medium 90.

As shown in FIGS. 1 to 3, the inkjet printer 10 is a so-called flat-bed type inkjet printer including a table 11 in which a support surface 11*a* for supporting the recording medium 90 from the lower side in the vertical direction indicated by an arrow Z is formed at the upper end in the vertical direction; and a leg 12 that supports the table 11; a plurality of inkjet heads 13 in which an ink ejection surfaces 13*a* formed with a plurality of nozzles for ejecting ink toward the surface 90*a* of the recording medium 90 supported by the table 11 is formed at the lower end in the vertical direction; a carriage 14 on which the plurality of inkjet heads 13 are mounted; a head gap sensor 15 that is mounted on the carriage 14 to detect a head gap 91 which is a distance in the vertical direction from the surface 90*a* of the recording medium 90 to the ink ejection surface 13*a* of the inkjet head 13; a Y-bar 16 serving as a main scan mechanism that extends in a left-right direction indicated by an arrow Y orthogonal to the vertical direction and supports the carriage 14 to be movable in the main scanning direction which is the left-right direction; two lifting mechanisms 20 that support the Y-bar 16 to be movable in the vertical direction with respect to the table 11; and two slide mechanisms 17 serving as a sub scan mechanism that extends in the front-back direction indicated by an arrow X orthogonal to both the vertical direction and the left-right direction and supports the Y-bar 16 through the lifting mechanism 20 so as to be movable in the sub scanning direction which is a front-back direction with respect to the table 11.

As the recording medium 90, various objects such as, for example, a relatively thick acrylic plate can be adopted.

In the table 11, a plurality of suction holes (not shown) for suctioning gas are formed in the support surface 11*a*.

The head gap sensor 15 is a position sensor that detects the position of the ink ejection surface 13*a* of the inkjet head 13 with respect to the surface 90*a* of the recording medium 90 in the vertical direction. The head gap sensor 15 may be a contact type sensor that detects the head gap 91 by bringing a member such as a pin into contact with the surface 90*a* of the recording medium 90 supported by the table 11, or a non-contact type sensor such as, for example, an optical sensor.

The lifting mechanisms 20 are provided one on each side of the table 11 in the left-right direction.

Figure 4:
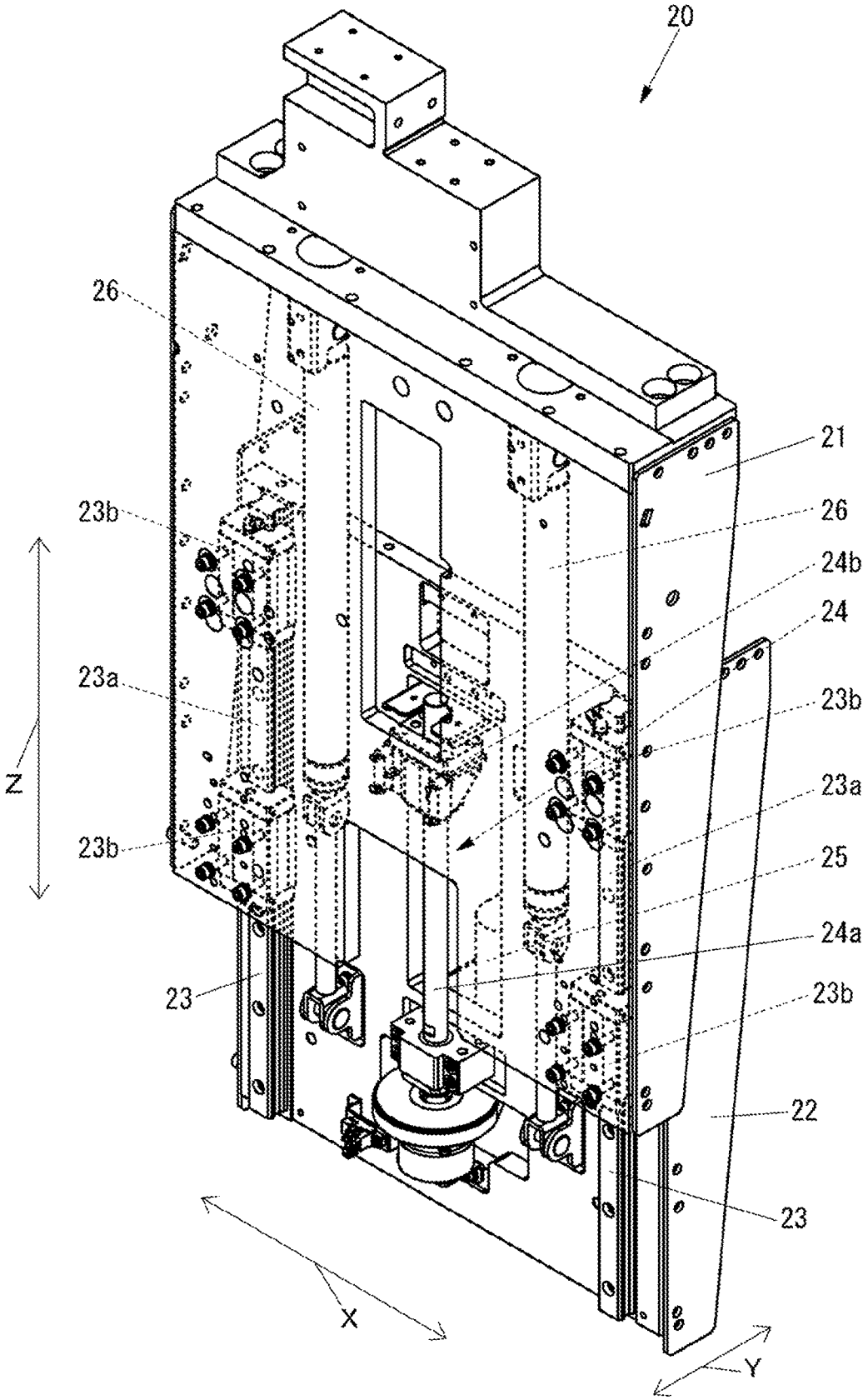
FIG. 4 is a perspective view of an lifting mechanism shown in FIG. 2 in an extended state.
Figure 5A:
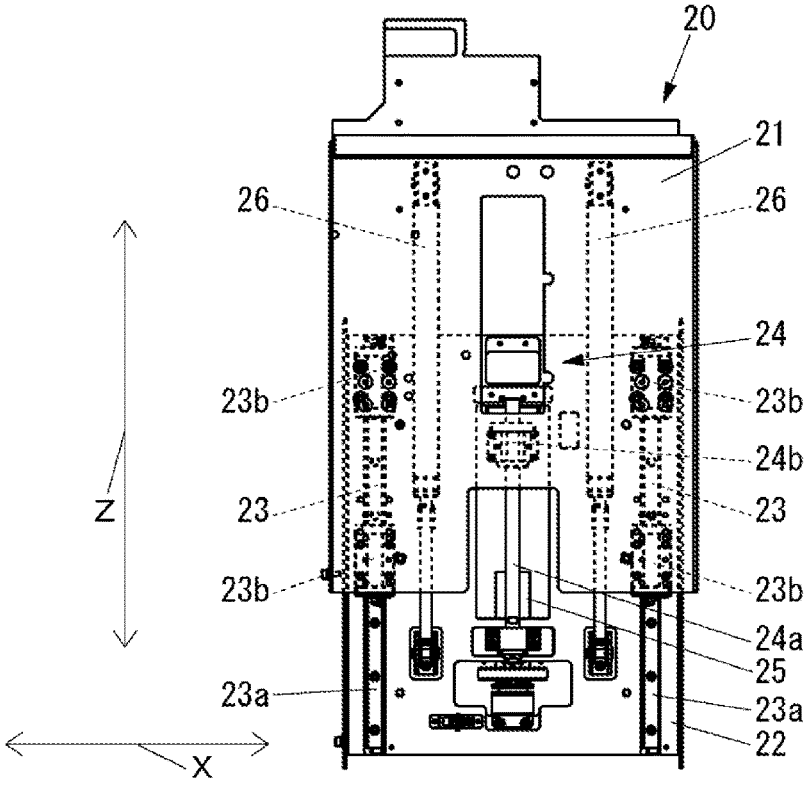
FIG. 5A is a side view of the lifting mechanism shown in FIG. 2 in an extended state.
Figure 5B:
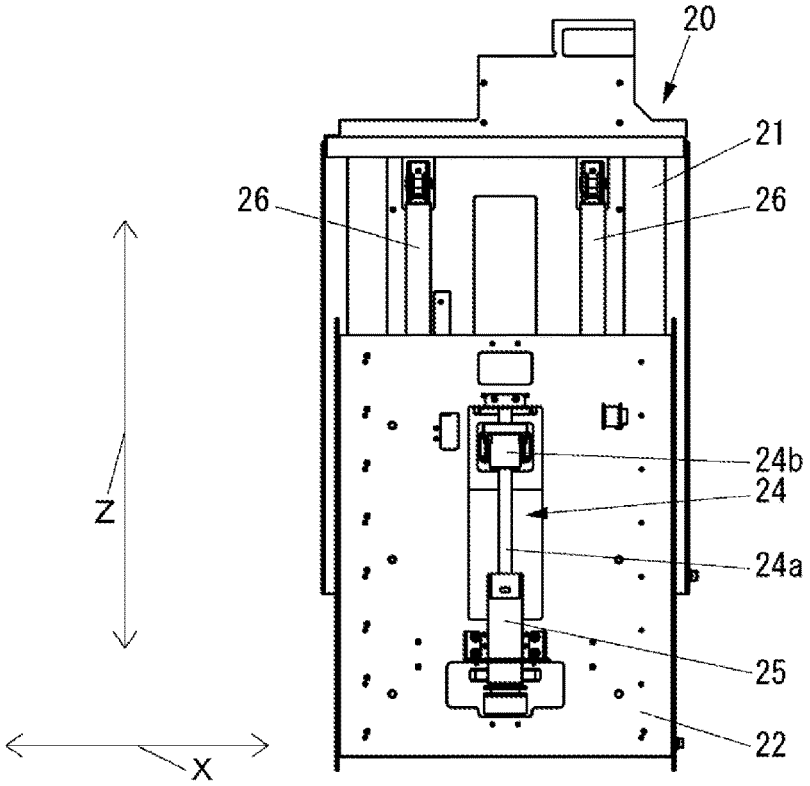
FIG. 5B is a side view of the lifting mechanism shown in FIG. 2 in the extended state, on a side opposite to the side shown in FIG. 5A.
Figure 6A:
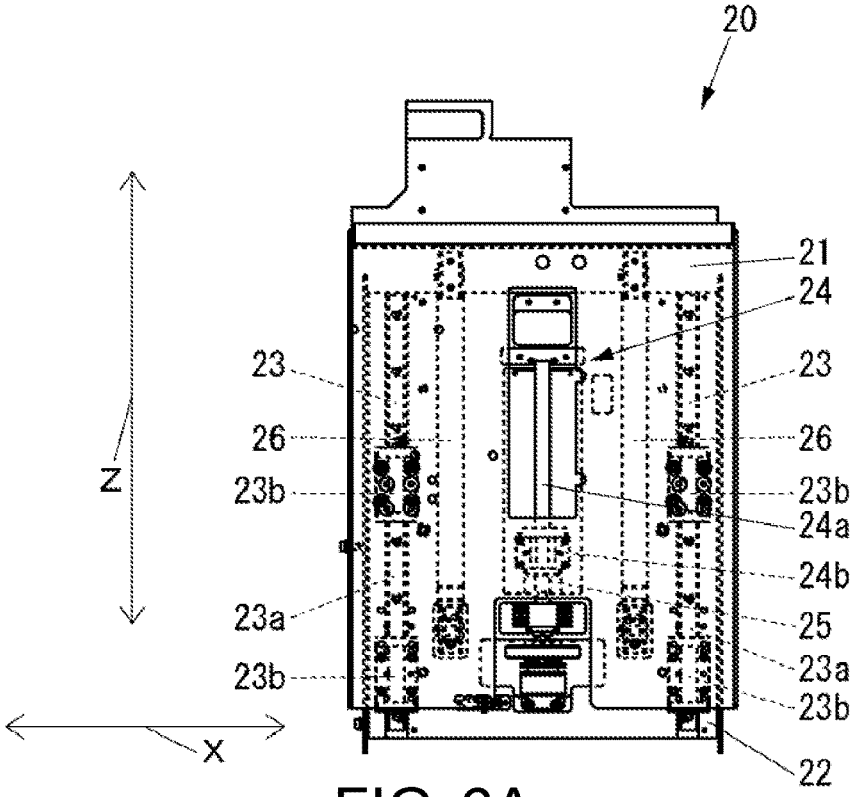
FIG. 6A is a side view of the lifting mechanism shown in FIG. 2 in a shortened state, on side same as the side shown in FIG. 5A.
Figure 6B:
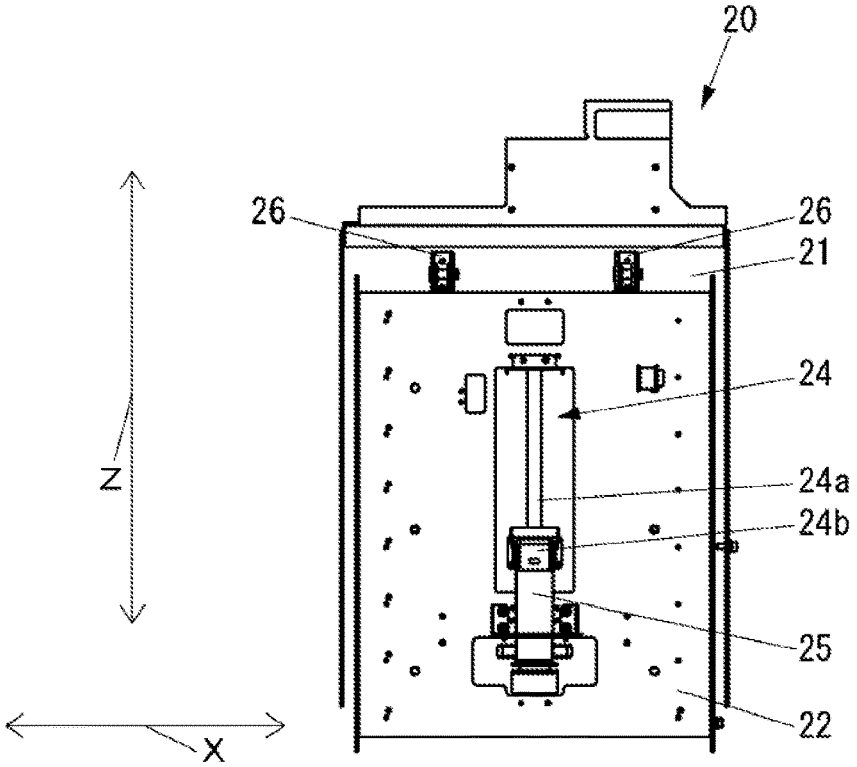
FIG. 6B is a side view of the lifting mechanism shown in FIG. 2 in the shortened state on a side opposite to the side shown in FIG. 6A.

FIG. 4 is a perspective view of the lifting mechanism 20 in the extended state. FIG. 5A is a side view of the lifting mechanism 20 in the extended state. FIG. 5B is a side view of the lifting mechanism 20 in the extended state, on a side opposite to the side shown in FIG. 5A. FIG. 6A is a side view of the lifting mechanism 20 in a shortened state, on side same as the side shown in FIG. 5A. FIG. 6B is a side view of the lifting mechanism 20 in the shortened state, on side same as the side shown in FIG. 6A.

As shown in FIGS. 4 to 6B, the lifting mechanism 20 includes an lifting member 21 that supports the Y-bar 16 (see FIG. 2) and moves the Y-bar 16 up and down, a fixing member 22 fixed to the portion on a movable side of the slide mechanism 17 (see FIG. 2), two linear motion (LM) guides 23 that support the lifting member 21 to be movable in the vertical direction with respect to the fixing member 22, a ball screw 24 and a motor 25 that moves the lifting member 21 in the vertical direction with respect to the fixing member 22, and two gas springs 26 that urge the lifting member 21 toward the upper side in the vertical direction with respect to the fixing member 22.

The LM guide 23 includes a guide rail 23*a* extending in the vertical direction and fixed to the fixing member 22, and two guide blocks 23*b* supported by the guide rail 23*a* to be movable in the vertical direction and fixed to the lifting member 21.

The ball screw 24 includes a screw shaft 24*a* extending in the vertical direction and rotatably supported by the fixing member 22, and a nut member 24*b* fixed to the lifting member 21 and screw-fitted to the screw shaft 24*a*.

The motor 25 is a motor that generates power for rotating the screw shaft 24*a*. As the motor 25, for example, any type of motor such as a stepping motor or a servo motor can be adopted.

The two lifting mechanisms 20 configure a tilt changing mechanism capable of changing a main scan mechanism tilt (hereinafter referred to as "Y-bar tilt") serving as an tilt of the Y-bar 16 with respect to the support surface 11*a* in an orthogonal surface extending in the left-right direction orthogonal to the support surface 11*a* (see FIG. 2) of the table 11 (see FIG. 2). The two lifting mechanisms 20 can change the Y-bar tilt by changing the positions in the vertical direction of both ends of the Y-bar 16 in the main scanning direction.

As shown in FIG. 2, one slide mechanism 17 is provided at each end of the table 11 in the left-right direction. The portion on the fixed side of the slide mechanism 17 is fixed to the table 11. To the portion on the movable side of the slide mechanism 17 is fixed the fixing member 22 of the lifting mechanism 20.

Figure 7:
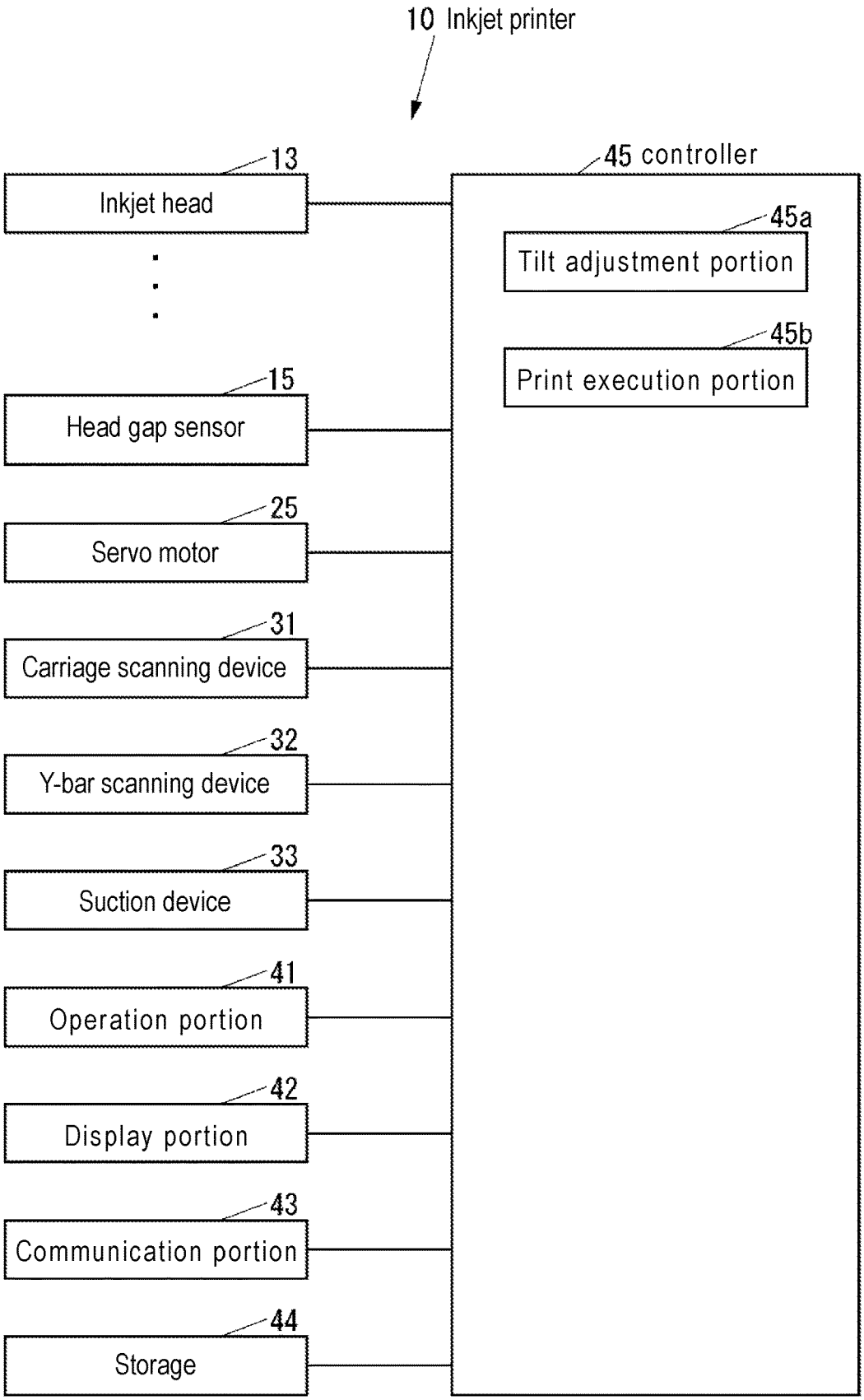
FIG. 7 is a block diagram of the inkjet printer shown in FIG. 1.

FIG. 7 is a block diagram of the inkjet printer 10.

As shown in FIG. 7, the inkjet printer 10 includes the inkjet head 13, the head gap sensor 15, the motor 25, a carriage scanning device 31 that moves the carriage 14 (see FIG. 1) in the left-right direction, that is, the main scanning direction along the Y-bar 16 (see FIG. 1), a Y-bar scanning device 32 that moves the Y-bar 16 in the front-back direction, that is, the sub scanning direction with respect to the table 11 (see FIG. 1), a suction device 33 that adsorbs the recording medium 90 (see FIG. 1) to the table 11 by suctioning gas through a plurality of suction holes formed in the support surface 11*a* (see FIG. 1) of the table 11, an operation portion 41 such as a button, for example, to which various operations are input, a display portion 42 such as a liquid crystal display (LCD), for example, that displays various information, a communication portion 43 which is a communication device that communicates with an external device through a network such as local area network (LAN) or Internet or direction in a wired or wireless manner without interposing the network, a storage 44 which is a nonvolatile storage device such as a semiconductor memory or a hard disk drive (HDD), for example, that stores various types of information, and a controller 45 that controls the entire inkjet printer 10.

The controller 45 includes, for example, a central processing unit (CPU), a read only memory (ROM) that stores programs and various data in advance, and a random access memory (RAM) used as a work area of the CPU. The CPU executes the program stored in the ROM or the storage 44.

The controller 45 realizes a tilt adjustment portion 45*a* that adjusts the Y-bar tilt and a print execution portion 45*b* that executes printing by executing a program stored in the ROM or the storage 44.

Next, the operation of the inkjet printer 10 will be described.

First, the operation of the inkjet printer 10 when adjusting the head gap 91 will be described.

The tilt adjustment portion 45*a* adsorbs the recording medium 90 onto the support surface 11*a* of the table 11 by the suction device 33 when adjusting the head gap 91.

Figure 8:
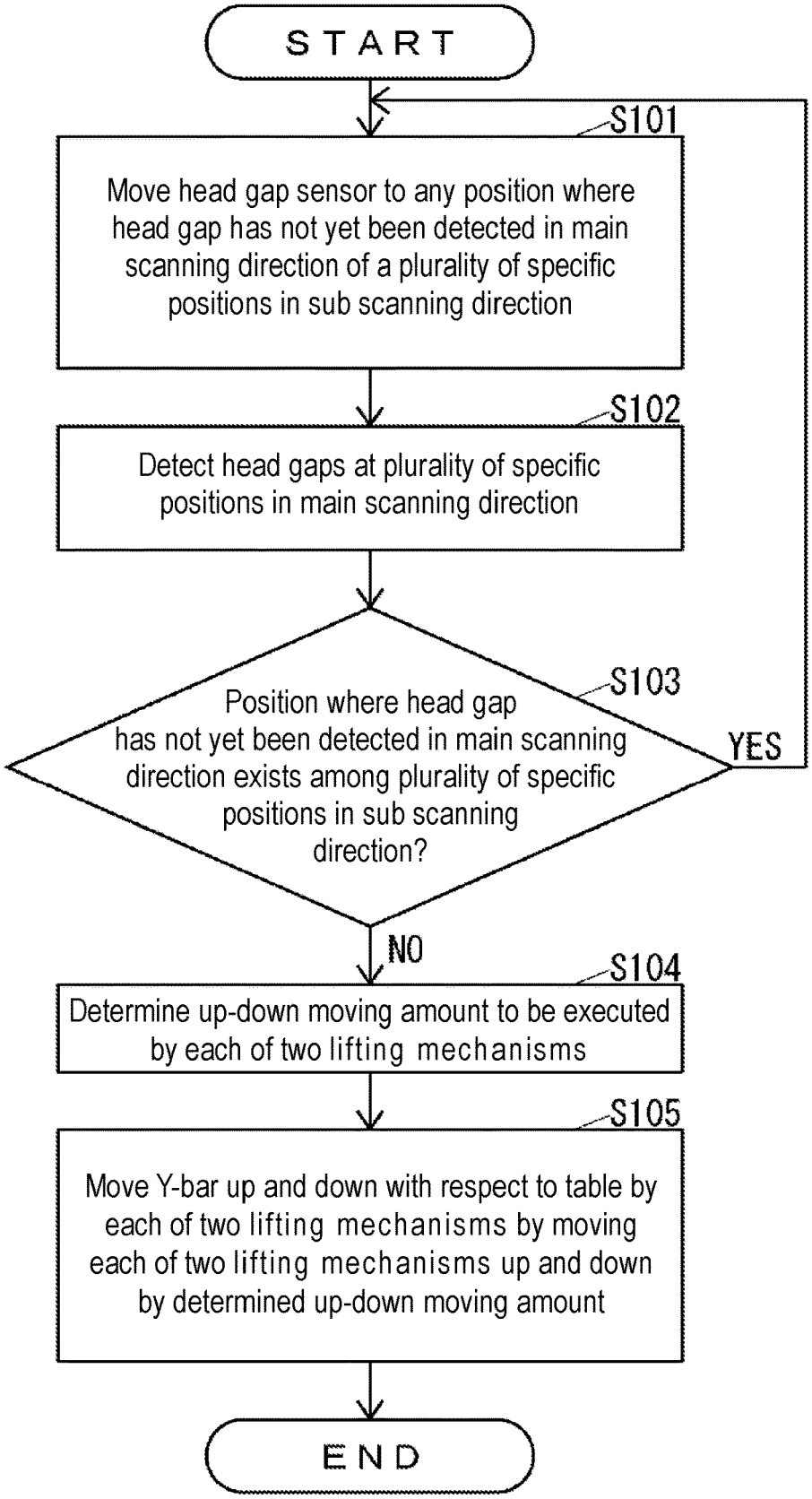
FIG. 8 is a flowchart of the operation of the inkjet printer shown in FIG. 1 when adjusting a head gap.

FIG. 8 is a flowchart of the operation of the inkjet printer 10 when adjusting the head gap 91.

The tilt adjustment portion 45*a* executes the operation shown in FIG. 8 at a specific timing, for example, a timing when the adjustment of the head gap 91 is instructed through the operation portion 41.

As shown in FIG. 8, the tilt adjustment portion 45*a* moves the Y-bar 16 with respect to the table 11 in the sub scanning direction by the Y-bar scanning device 32 to move the head gap sensor 15 to any position where the head gap 91 has not yet been detected in the main scanning direction of a plurality of specific positions with respect to the recording medium 90 in the sub scanning direction (S101).

Then, the tilt adjustment portion 45*a* detects the head gap 91 by the head gap sensor 15 at a plurality of specific positions with respect to the recording medium 90 in the main scanning direction by moving the carriage 14 in the main scanning direction by the carriage scanning device 31 (S102).

Next, the tilt adjustment portion 45*a* determines whether or not there is a position, in the main scanning direction, where the head gap 91 has not yet been detected of the plurality of specific positions with respect to the recording medium 90 in the sub scanning direction (S103).

When determining in S103 that there is a position in the main scanning direction where the head gap 91 has not yet been detected of the plurality of specific positions with respect to the recording medium 90 in the sub scanning direction, the tilt adjustment portion 45*a* executes the process of S101.

When determining in S103 that there is no position in the main scanning direction where the head gap 91 has not yet been detected of the plurality of specific positions with respect to the recording medium 90 in the sub scanning direction, the tilt adjustment portion 45*a* determines the up-down moving amount to be executed by each of the two lifting mechanisms 20, respectively, based on the head gaps 91 at all positions detected in S102 (S104).

Hereinafter, an example of a method of determining the up-down moving amount to be executed by each of the two lifting mechanisms 20 will be described.

Figure 9:
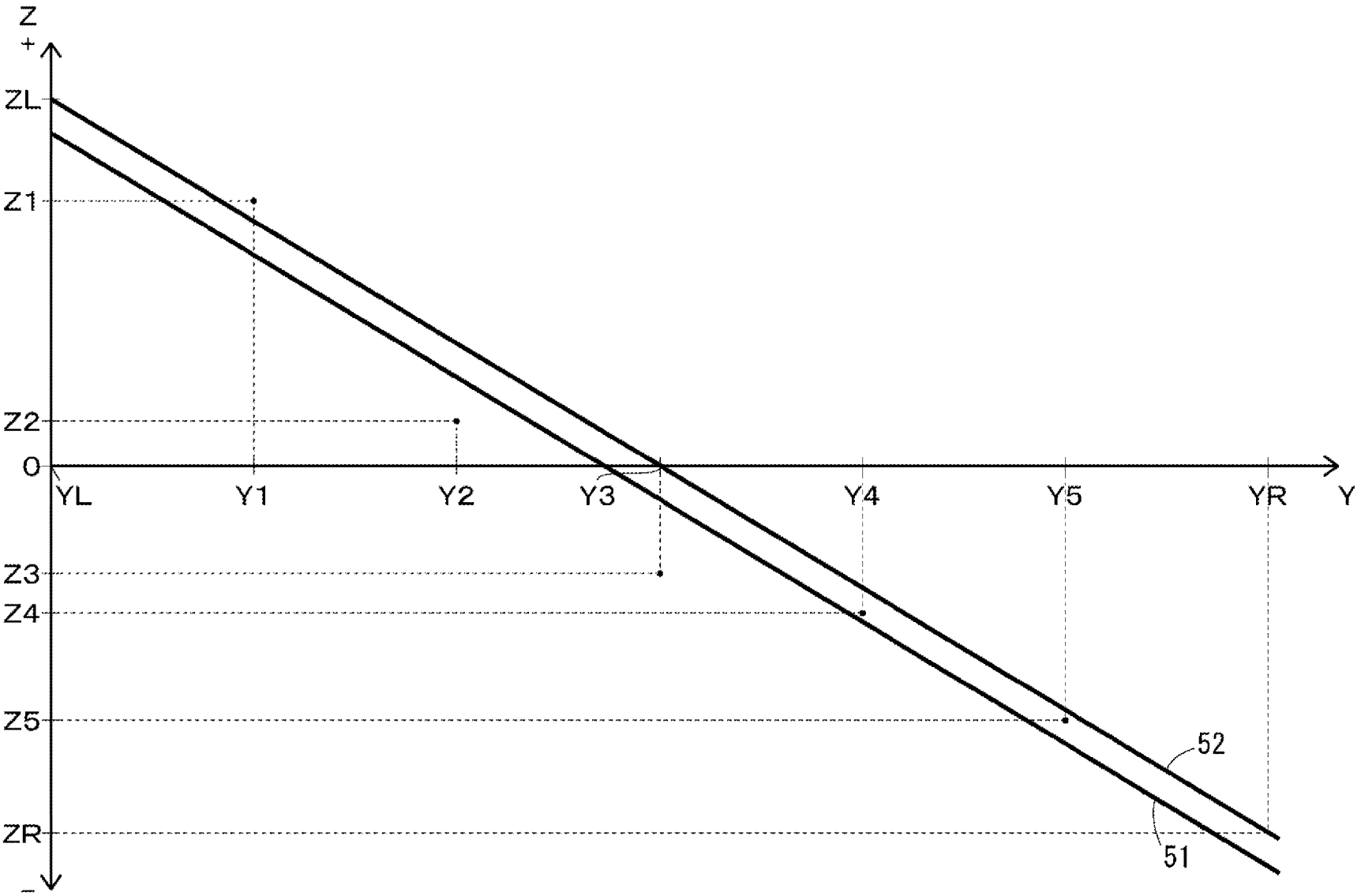
FIG. 9 is a view showing an example of a difference between an actual head gap and an ideal head gap at a specific position with respect to a recording medium shown in FIG. 1 in a main scanning direction.

FIG. 9 is a view showing an example of a difference between an actual head gap 91 and an ideal head gap at a specific position with respect to the recording medium 90 in the main scanning direction.

In FIG. 9, the Y axis is an axis indicating the position in the main scanning direction. The position YL is a position where the lifting mechanism 20 on the left side of the two lifting mechanisms 20 supports the Y-bar 16. The position YR is a position where the lifting mechanism 20 on the right side of the two lifting mechanisms 20 supports the Y-bar 16. The positions Y1 to Y5 are examples of a plurality of specific positions with respect to the recording medium 90 in the main scanning direction.

In FIG. 9, the Z axis is an axis indicating the difference between the actual head gap 91 and the ideal head gap. The ideal head gap is the same at any position with respect to the recording medium 90 in the main scanning direction, and is shown as 0 on the Z axis in FIG. 9. A positive value on the Z-axis means that the actual head gap 91 is larger than the ideal head gap. For example, the difference Z1 is the difference between the actual head gap 91 and the ideal head gap at the position Y1. Similarly, the differences Z2 to Z5 are the differences between the actual head gap 91 and the ideal head gap at the positions Y2 to Y5, respectively. However, ZL indicates the up-down moving amount to be executed by the lifting mechanism 20 on the left side of the two lifting mechanisms 20, which is obtained by considering only the differences Z1 to Z5. Similarly, ZR indicates the up-down moving amount to be executed by the lifting mechanism 20 on the right side of the two lifting mechanisms 20, which is obtained by considering only the differences Z1 to Z5. Here, in FIG. 9, when the up-down moving amount is a positive value, it means that the Y-bar 16 should be moved down by the lifting mechanism 20 by that amount. Similarly, in FIG. 9, when the up-down moving amount is a negative value, it means that the Y-bar 16 should be moved up by the lifting mechanism 20 by that amount.

When the differences Z1 to Z5 shown in FIG. 9 are obtained as a difference between the actual head gap 91 and the ideal head gap at specific positions with respect to the recording medium 90 in the main scanning direction, the tilt adjustment portion 45*a* can obtain an approximate straight line 51 as shown in FIG. 9 by, for example, least squares method, and the like. Then, the tilt adjustment portion 45*a* can obtain a straight line 52 that is parallel to the approximate straight line 51 and in which an average of the values on the Z axis at the positions Y1 to Y5 becomes zero. Here, the value of 0 on the Z axis indicates that the head gap is ideal, as described above. Therefore, the straight line 52 is a straight line in which the average of the head gaps 91 at the positions Y1 to Y5 becomes a specific value, that is, an ideal head gap. The tilt adjustment portion 45*a* can obtain ZL and ZR from the straight line 52.

When the tilt adjustment portion 45*a* obtains ZL at a plurality of specific positions with respect to the recording medium 90 in the sub scanning direction, the tilt adjustment portion 45*a* averages these ZL to obtain the up-down moving amount to be executed by the lifting mechanism 20 on the left side of the two lifting mechanisms 20. Similarly, when the tilt adjustment portion 45*a* obtains ZR at a plurality of specific positions with respect to the recording medium 90 in the sub scanning direction, the tilt adjustment portion 45*a* averages these ZR to obtain the up-down moving amount to be executed by the lifting mechanism 20 on the right side of the two lifting mechanisms 20.

In the above description, an example of the method of determining the up-down moving amount to be executed by each of the two lifting mechanisms 20 has been described, but the up-down moving amount to be executed by each of the two lifting mechanisms 20 may be determined by a method other than the method described above.

As shown in FIG. 8, after the processing of S104, the tilt adjustment portion 45*a* drives the respective motors 25 of the two lifting mechanisms 20 to move each of the two lifting mechanisms 20 up and down by the up-down moving amount determined in S104, thus moving the Y-bar 16 up and down with each each of the two lifting mechanisms 20 with respect to the table 11 (S105), and the operation shown in FIG. 8 is terminated.

Next, the operation of the inkjet printer 10 when executing printing will be described.

The print execution portion 45*b* suctions the recording medium 90 onto the support surface 11*a* of the table 11 by the suction device 33 when executing printing on the surface 90*a* of the recording medium 90.

Upon receiving the print data through the communication portion 43, the print execution portion 45*b* executes printing on the surface 90*a* of the recording medium 90 based on the print data. That is, the print execution portion 45*b* moves the carriage 14 in the main scanning direction by the carriage scanning device 31 and ejects the ink toward the surface 90*a* of the recording medium 90 by the inkjet head 13 to execute printing on the surface 90*a* of the recording medium 90 in the main scanning direction. In addition, when the print execution portion 45*b* executes printing on the surface 90*a* of the recording medium 90 in the main scanning direction, the print execution portion 45*b* moves the Y-bar 16 with respect to the table 11 in the sub scanning direction by the Y-bar scanning device 32, as necessary, to change the position of printing with respect to the surface 90*a* of the recording medium 90 in the sub scanning direction, and thereafter, again executes printing on the surface 90*a* of the recording medium 90 in the main scanning direction.

As described above, the inkjet printer 10 adjusts the position of the ink ejection surface 13*a* of the inkjet head 13 with respect to the surface 90*a* of the recording medium 90 in the vertical direction to reduce the variation in the head gap 91 at a plurality of points in the direction orthogonal to the vertical direction, that is, in the horizontal direction (S101 to S105), and thus can improve the uniformity in the horizontal direction of the accuracy of the landing position of the ink ejected toward the surface 90*a* of the recording medium 90 by the inkjet head 13 to the surface 90*a* of the recording medium 90, and consequently, can improve the uniformity in the horizontal direction of the quality of the image printed on the surface 90*a* of the recording medium 90.

The inkjet printer 10 adjusts the Y-bar tilt by the two lifting mechanisms 20 to a tilt that reduces the variation of the head gap 91 detected by the head gap sensor 15 at each of a plurality of positions in the main scanning direction (S101 to S105) to reduce the variation in the head gap 91 at each of the plurality of positions in the main scanning direction, and thus can improve the uniformity in the main scanning direction of the accuracy of the landing position of the ink ejected toward the surface 90*a* of the recording medium 90 by the inkjet head 13 to the surface 90*a* of the recording medium 90, and consequently, can improve the uniformity in the main scanning direction of the quality of the image printed on the surface 90*a* of the recording medium 90.

In particular, the inkjet printer 10 reduces the variation in the head gap 91 detected by the head gap sensor 15 at each of a plurality of positions in the main scanning direction at each of a plurality of positions in the sub scanning direction (S101 to S105), and thus can improve the uniformity in both the main scanning direction and the sub scanning direction of the accuracy of the landing position of the ink ejected toward the surface 90*a* of the recording medium 90 by the inkjet head 13 to the surface 90*a* of the recording medium 90, and consequently, can improve the uniformity in both the main scanning direction and the sub scanning direction of the quality of the image printed on the surface 90*a* of the recording medium 90.

In the operation shown in FIG. 8, the inkjet printer 10 determines the up-down moving amount to be executed by each of the two lifting mechanisms 20 based on the head gaps 91 at a plurality of positions in the main scanning direction at a plurality of positions in the sub scanning direction. However, as shown in FIG. 10, the inkjet printer 10 may determine the up-down moving amount to be executed by each of the two lifting mechanisms 20 based on the head gaps 91 at a plurality of positions in the main scanning direction at one position in the sub scanning direction.

Figure 10:
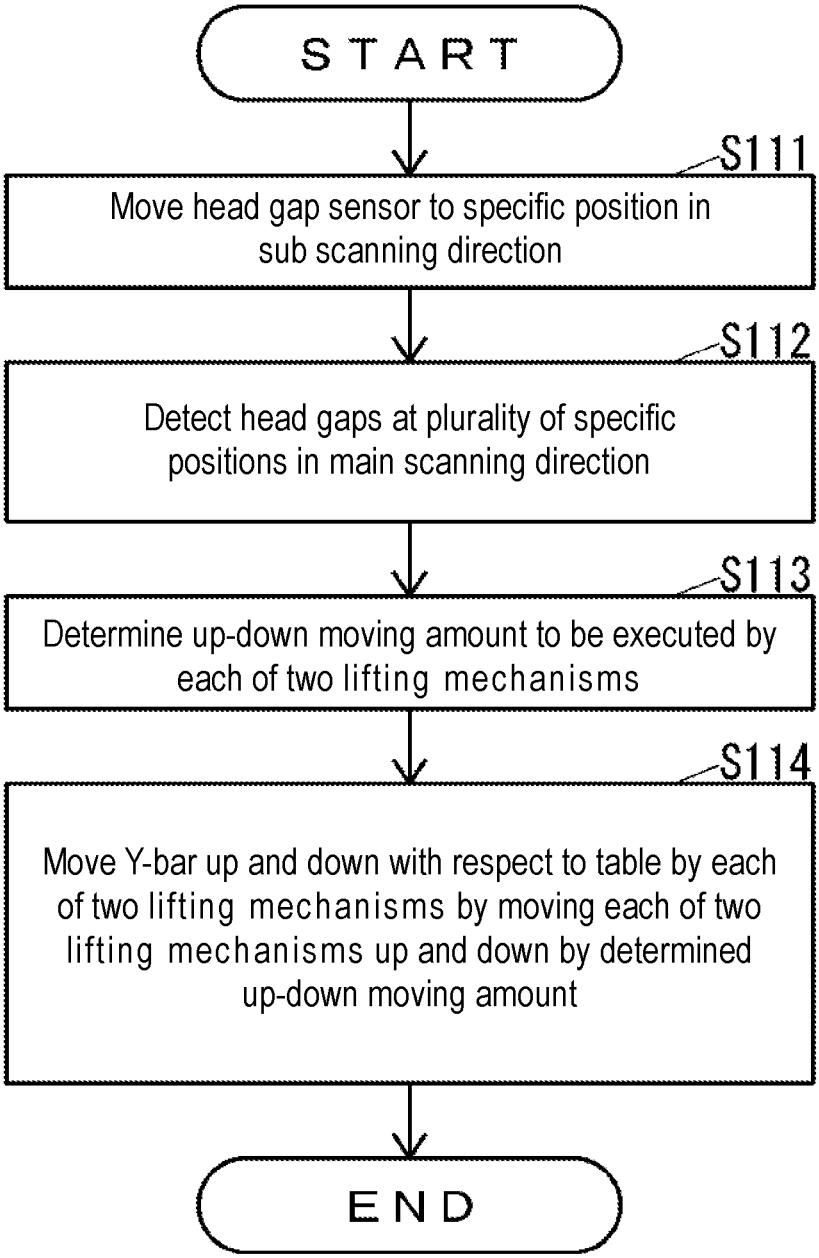
FIG. 10 is a flowchart of the operation of the inkjet printer shown in FIG. 1 when adjusting the head gap, in an example different from the example shown in FIG. 8.

FIG. 10 is a flowchart of the operation of the inkjet printer 10 when adjusting the head gap 91, in an example different from the example shown in FIG. 8.

The tilt adjustment portion 45*a* executes the operation shown in FIG. 10 at a specific timing, for example, a timing when the adjustment of the head gap 91 is instructed through the operation portion 41.

As shown in FIG. 10, the tilt adjustment portion 45*a* moves the head gap sensor 15 to a specific position with respect to the recording medium 90 in the sub scanning direction by moving the Y-bar 16 with respect to the table 11 in the sub scanning direction by the Y-bar scanning device 32 (S111). Here, of the positions in the sub scanning direction, the position to move the head gap sensor 15 in S111 may be, for example, the position when the position of the Y-bar 16 in the sub scanning direction is the position of origin.

Then, the tilt adjustment portion 45*a* detects the head gap 91 by the head gap sensor 15 at a plurality of specific positions with respect to the recording medium 90 in the main scanning direction by moving the carriage 14 in the main scanning direction by the carriage scanning device 31 (S112).

Next, the tilt adjustment portion 45*a* determines the up-down moving amount to be executed by each of the two lifting mechanisms 20 based on the head gaps 91 at all positions detected in S112 (S113).

Then, the tilt adjustment portion 45*a* drives the respective motors 25 of the two lifting mechanisms 20 to move each of the two lifting mechanisms 20 up and down by the up-down moving amount determined in S113, thereby moving the Y-bar 16 up and down relative to the table 11 by each of the two lifting mechanisms 20 (S114), and the operation shown in FIG. 10 is terminated.

Figure 11:
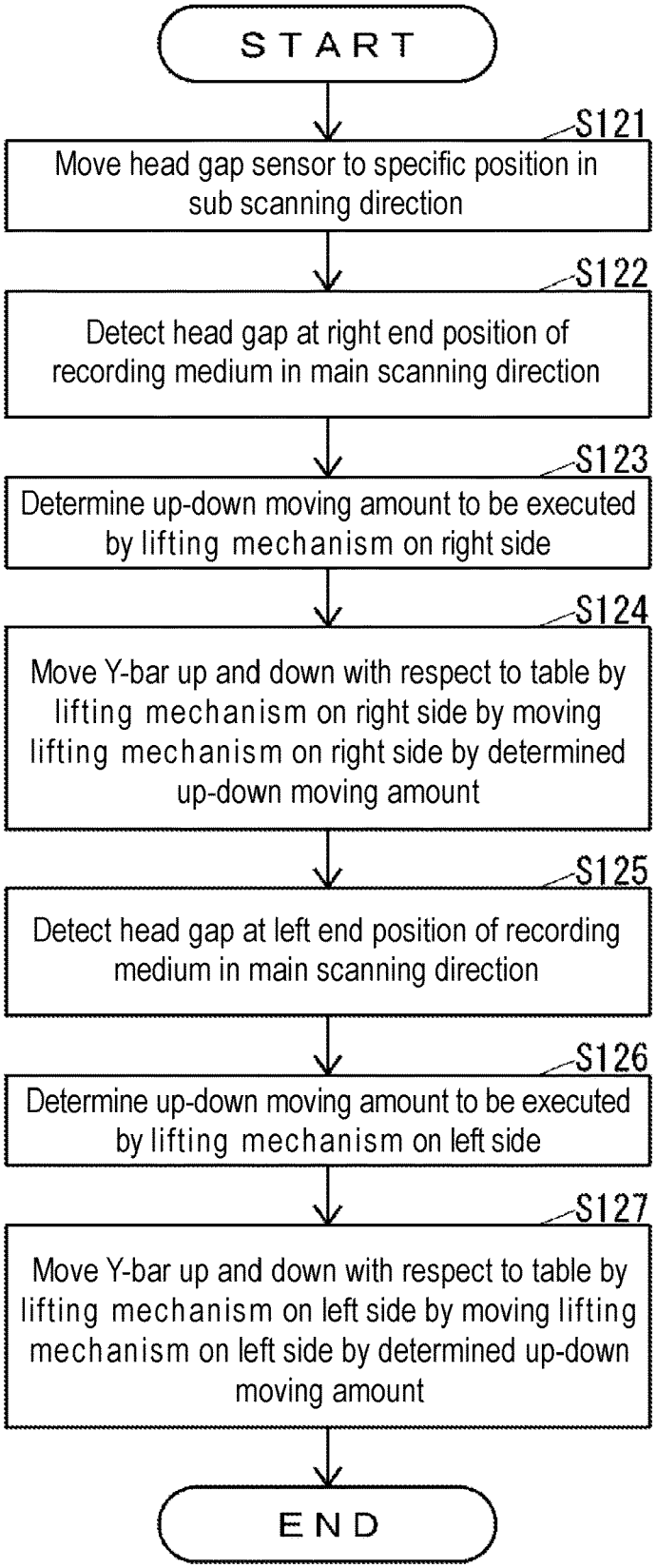
FIG. 11 is a flowchart of the operation of the inkjet printer shown in FIG. 1 when adjusting the head gap, in an example different from the examples shown in FIGS. 8 and 10.

Note that the inkjet printer 10 may determine the up-down moving amount to be executed by each of the two lifting mechanisms 20 based only on the head gaps 91 at both ends in the main scanning direction at one position in the sub scanning direction, for example, as in the operation shown in FIG. 11.

FIG. 11 is a flowchart of the operation of the inkjet printer 10 when adjusting the head gap 91, in an example different from the examples shown in FIGS. 8 and 10.

The tilt adjustment portion 45*a* executes the operation shown in FIG. 11 at a specific timing, for example, a timing when the adjustment of the head gap 91 is instructed through the operation portion 41.

As shown in FIG. 11, the tilt adjustment portion 45*a* moves the head gap sensor 15 to a specific position with respect to the recording medium 90 in the sub scanning direction by moving the Y-bar 16 with respect to the table 11 in the sub scanning direction by the Y-bar scanning device 32 (S121). Here, of the positions in the sub scanning direction, the position to move the head gap sensor 15 in S121 may be, for example, the position when the position of the Y-bar 16 in the sub scanning direction is the position of origin.

Then, the tilt adjustment portion 45*a* detects the head gap 91 by the head gap sensor 15 at a right end position of the recording medium 90 in the main scanning direction by moving the carriage 14 in the main scanning direction by the carriage scanning device 31 (S122).

Next, the tilt adjustment portion 45*a* determines the up-down moving amount to be executed by the lifting mechanism 20 on the right side in the main scanning direction of the two lifting mechanisms 20, based on the head gap 91 detected in S122 (S123). For example, the tilt adjustment portion 45*a* determines in S123 the up-down moving amount necessary for the head gap 91 detected by the head gap sensor 15 to become the ideal head gap at the right end position of the recording medium 90 in the main scanning direction.

Then, the tilt adjustment portion 45*a* drives the motor 25 of the lifting mechanism 20 on the right side in the main scanning direction of the two lifting mechanisms 20 to move the lifting mechanism 20 up and down by the up-down moving amount determined in S123, thus moving the Y-bar 16 up and down with respect to the table 11 with the lifting mechanism 20 (S124).

Then, the tilt adjustment portion 45*a* detects the head gap 91 by the head gap sensor 15 at a left end position of the recording medium 90 in the main scanning direction by moving the carriage 14 in the main scanning direction by the carriage scanning device 31 (S125).

Next, the tilt adjustment portion 45*a* determines the up-down moving amount to be executed by the lifting mechanism 20 on the left side in the main scanning direction of the two lifting mechanisms 20, based on the head gaps 91 detected in S125 (S126). For example, the tilt adjustment portion 45*a* determines in S126 the up-down moving amount necessary for the head gap 91 detected by the head gap sensor 15 to become the ideal head gap at the left end position of the recording medium 90 in the main scanning direction.

Then, the tilt adjustment portion 45*a* drives the motor 25 of the lifting mechanism 20 on the left side in the main scanning direction of the two lifting mechanisms 20 to move such lifting mechanism 20 up and down by the up-down moving amount determined in S126, thereby moving the Y-bar 16 up and down relative to the table 11 by the lifting mechanism 20 (S127), and the operation shown in FIG. 11 is terminated.

The inkjet printer 10 realizes both the change of the Y-bar tilt and the change of the average of the head gaps 91 detected by the head gap sensor 15 at each of the plurality of positions in the main scanning direction by the two lifting mechanisms 20, and thus the size can be reduced as compared with a configuration in which a mechanism for changing the average of the head gaps 91 at each of a plurality of positions in the main scanning direction is provided other than the tilt changing mechanism.

The inkjet printer 10 may include a mechanism for changing the average of the head gaps 91 at each of a plurality of positions in the main scanning direction, other than the tilt changing mechanism. When the inkjet printer 10 is provided with a mechanism for changing the average of the head gap 91 at each of a plurality of positions in the main scanning direction other than the tilt changing mechanism, the lifting mechanism 20 is provided only on one end side of the Y-bar 16 in the main scanning direction, and the other end side of the Y-bar 16 in the main scanning direction may be rotatable about a straight line extending in the front-back direction whose position in the vertical direction is fixed.

In the present embodiment, the inkjet printer 10 changes the position of the ink ejection surface 13*a* of the inkjet head 13 with respect to the surface 90*a* of the recording medium 90 in the main scanning direction by moving the carriage 14, on which the inkjet head 13 is mounted, in the main scanning direction. However, the inkjet printer 10 may merely change the position of the ink ejection surface 13*a* of the inkjet head 13 with respect to the surface 90*a* of the recording medium 90 in the main scanning direction by moving one of the table 11 and the inkjet head 13 relative to the other in the main scanning direction. For example, the inkjet printer 10 may change the position of the ink ejection surface 13*a* of the inkjet head 13 with respect to the surface 90*a* of the recording medium 90 in the main scanning direction by moving the recording medium 90 in the main scanning direction.

In the present embodiment, the inkjet printer 10 changes the position of the ink ejection surface 13*a* of the inkjet head 13 with respect to the surface 90*a* of the recording medium 90 in the sub scanning direction by moving the Y-bar 16 in the sub scanning direction. However, the inkjet printer 10 may merely change the position of the ink ejection surface 13*a* of the inkjet head 13 with respect to the surface 90*a* of the recording medium 90 in the sub scanning direction by moving one of the table 11 and the inkjet head 13 relative to the other in the sub scanning direction. For example, the inkjet printer 10 may change the position of the ink ejection surface 13*a* of the inkjet head 13 with respect to the surface 90*a* of the recording medium 90 in the sub scanning direction by moving the recording medium 90 in the sub scanning direction.

In the present embodiment, the inkjet printer 10 adjusts the head gap 91 by tilting the Y-bar 16. However, the inkjet printer 10 may adjust the head gap 91 by tilting the support surface 11*a* of the table 11. When adjusting the head gap 91 by tilting the support surface 11*a* of the table 11, the inkjet printer 10 can change not only the tilt in the rotating direction about the rotation axis extending in the X direction but also the tilt in the rotating direction about the rotation shaft extending in a direction other than the X direction. That is, when the head gap 91 is adjusted by tilting the support surface 11*a* of the table 11, the inkjet printer 10 can reduce the variation in the head gap 91 detected by the head gap sensor 15 at each of a plurality of positions in the main scanning direction at each of a plurality of positions in the sub scanning direction.

The head gap sensor 15 may not be configured to directly detect the position of the ink ejection surface 13*a* of the inkjet head 13 in the vertical direction. For example, the head gap sensor 15 may indirectly detect the head gap 91 by detecting the position in the vertical direction of a portion other than the ink ejection surface 13*a* of the inkjet head 13 such as the position in the vertical direction of a part of the carriage 14 on which the inkjet head 13 is mounted, the position in the vertical direction of a part of the Y-bar 16 supporting the carriage 14 on which the inkjet head 13 is mounted, and the like.

What is claimed is:

1. An inkjet printer comprising:

a table, provided with a support surface for supporting a recording medium, and the support surface being a plane extending in an X direction and a Y direction orthogonal to each other;

an inkjet head, provided with an ink ejection surface that ejects ink toward a surface of the recording medium supported by the support surface;

a position changing mechanism, configured to change a position of the ink ejection surface with respect to the surface in at least one of the X direction and the Y direction by relatively moving one of the table and the inkjet head with respect to the other one of the table and the inkjet head in at least one of the X direction and the Y direction;

a position sensor, configured to detect a position of the ink ejection surface with respect to the surface in a Z direction orthogonal to both the X direction and the Y direction; and an adjustment mechanism, configured to:

change the position of the ink ejection surface with respect to the surface by the position changing mechanism, detect the position in the Z direction at a plurality of points in a direction orthogonal to the Z direction by the position sensor, and adjust the position of the ink ejection surface with respect to the surface in the Z direction to reduce variation in a head gap, which is a distance in the Z direction from the surface to the ink ejection surface at the plurality of points;

the position changing mechanism includes a main scan mechanism that extends in a main scanning direction serving as the Y direction and supports the inkjet head so as to be movable in the main scanning direction, and the adjustment mechanism includes:

a tilt changing mechanism, configured to be capable of changing a main scan mechanism tilt serving as a tilt of the main scan mechanism with respect to the support surface in an orthogonal surface orthogonal to the support surface, and a tilt adjustment portion, configured to adjust the main scan mechanism tilt by the tilt changing mechanism to a tilt that reduces variations in the head gap detected by the position sensor at each of a plurality of positions in the main scanning direction;

the tilt changing mechanism is configured to be capable of changing the main scan mechanism tilt by changing the position in the Z direction of each end of the main scan mechanism in the main scanning direction, and when the main scan mechanism tilt is adjusted by the tilt changing mechanism, the tilt adjustment portion is configured to adjust the position in the Z direction of each end of the main scan mechanism in the main scanning direction by the tilt changing mechanism to a position where an average of the head gaps detected by the position sensor becomes a specific value at each of a plurality of positions in the main scanning direction.

* * * * *